US005345801A

United States Patent [19]

Paakkunainen

[11] Patent Number: 5,345,801

[45] Date of Patent: Sep. 13, 1994

[54] PROCEDURE AND APPARATUS FOR FORMING A RECTANGULAR COLLAR AT THE END OF A PIPE

[75] Inventor: Matti Paakkunainen, Hyvinkää, Finland

[73] Assignee: GS-Hydro OY, Hameenlinna, Finland

[21] Appl. No.: 44,467

[22] Filed: Apr. 9, 1993

[30] Foreign Application Priority Data

Apr. 10, 1992 [FI] Finland ..... 921627

[51] Int. Cl.[5] ..... B21D 19/04

[52] U.S. Cl. ..... 72/117; 72/123; 72/125

[58] Field of Search ..... 72/115, 117, 118, 119, 72/120, 123, 124, 125, 126

[56] References Cited

U.S. PATENT DOCUMENTS

| | | | |
|---|---|---|---|
| 782,005 | 2/1905 | Chandler | 72/123 |
| 1,436,489 | 11/1922 | Ferrier | 72/125 |
| 1,775,766 | 9/1930 | Holmes | 72/117 |
| 4,905,492 | 3/1990 | Lobakk . | |

FOREIGN PATENT DOCUMENTS

| | | | |
|---|---|---|---|
| 167585 | 8/1921 | United Kingdom | 72/117 |

*Primary Examiner*—Lowell A. Larson

[57] ABSTRACT

A procedure and an apparatus for forming a rectangular collar at the end of a pipe (16) shape the pipe using a forming element (8) which is moved in the axial direction of the pipe (16) towards the pipe (16) and rotated along the edge surface of the pipe end about the longitudinal axis of the pipe. In the procedure, a conical collar is first produced, whereupon the forming element (8) is moved in the axial direction of the pipe away from the pipe (16) and turned to a position where its forming face is substantially perpendicular to the longitudinal axis of the pipe, whereupon a rectangular collar is formed. The apparatus is provided with a turning device (15) allowing the forming element to be turned about its fulcrum (9) into a first position, where the surface of the forming element is at an acute angle to the direction of the longitudinal axis of the pipe and the forming element (8) is supported by a first bearing surface (13), and into a second position, where the surface of the forming element is substantially perpendicular to the direction of the longitudinal axis of the pipe and the forming element (8) is supported by a second bearing surface (14).

20 Claims, 5 Drawing Sheets

PROCEDURE AND APPARATUS FOR FORMING A RECTANGULAR COLLAR AT THE END OF A PIPE

FIELD OF THE INVENTION

The present invention relates to a procedure and an apparatus for forming a rectangular collar at the end of a pipe.

DESCRIPTION OF THE BACKGROUND ART

In joining pipes together, a possible alternative is to form perpendicular flanges at the ends of the pipes to be joined, which are then coupled together. In the case of pipes that can be plastically worked up, the flange can be formed by suitably shaping the pipe end. However, if the pipe diameter and the thickness of the pipe wall is large, a considerable force is needed for the shaping operation. Forming a collar on a pipe with a diameter of 200–400 mm requires a force of several thousand kilopond. In this case, the bearing elements transmitting the force constitute an important part of the functional whole.

In a previously known solution (patent application FI A 870799), a collar at an angle of 35°–40° is first formed at the pipe end, then the forming cone is replaced or an auxiliary forming head is mounted on it, whereupon a final rectangular collar is formed. The cone is held in a chuck by its shaft, the chuck being rotatably mounted on the frame. In another known device, the forming cone can be mounted at different positions in the chuck to permit the formation of collars on pipes of different sizes. In the known solutions, the forming cone must be fitted anew between the first and second stages of the operation, and the cone is only supported by one end. Moreover, a separate fit is needed for each pipe size.

SUMMARY OF THE INVENTION

The object of the present invention is to achieve a new procedure and apparatus which is fast and simple to operate and in which the drawbacks of the previously known solutions have been corrected. To accomplish this, in the procedure of the invention, after a conical collar has been formed, the forming element is moved in the direction of the axis of the pipe away from the pipe and turned so that its forming face is substantially perpendicular to the longitudinal axis of the pipe, whereupon a rectangular collar is formed in a manner known in itself by moving the forming element towards the pipe in the direction of its axis and by rotating the forming element along the edge surface of the pipe. The apparatus of the invention is provided with turning means allowing the forming element to be turned about a fulcrum into a first position, where the surface of the forming element is at an acute angle to the direction of the longitudinal axis of the pipe and the forming element is supported by a first bearing surface, and into a second position, where the surface of the forming element is at right angles to the direction of the longitudinal axis of the pipe and the forming element is supported by a second bearing surface.

In an embodiment of the invention, the forming element is mounted in a tool body which moves it by means of a sliding carriage movable in a direction perpendicular to the pipe. Thus, the forming element can be moved to a suitable distance from the pipe axis corresponding to diameter of the pipe and secured in that position by means of locking elements.

Using the apparatus of the invention, a collar is formed on a pipe in a simple and efficient manner without intermediate mounting of the forming element between stages of the shaping operation. The tools used are large and heavy because of the material and dimensions of the pipes to be shaped, and replacing and mounting them requires a considerable deal of physical strength. As the apparatus of the invention uses only one forming element, the work becomes substantially easier. Besides, in this apparatus the axial force is transmitted to the object under shaping via parts properly supported.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of one of its embodiments by referring to the drawings which are given by way of illustration only, and thus are not limitative of the present invention, and in which.

DETAILED DESCRIPTION OF THE PREFERRED EMBODIMENTS

Figures 1, 2:
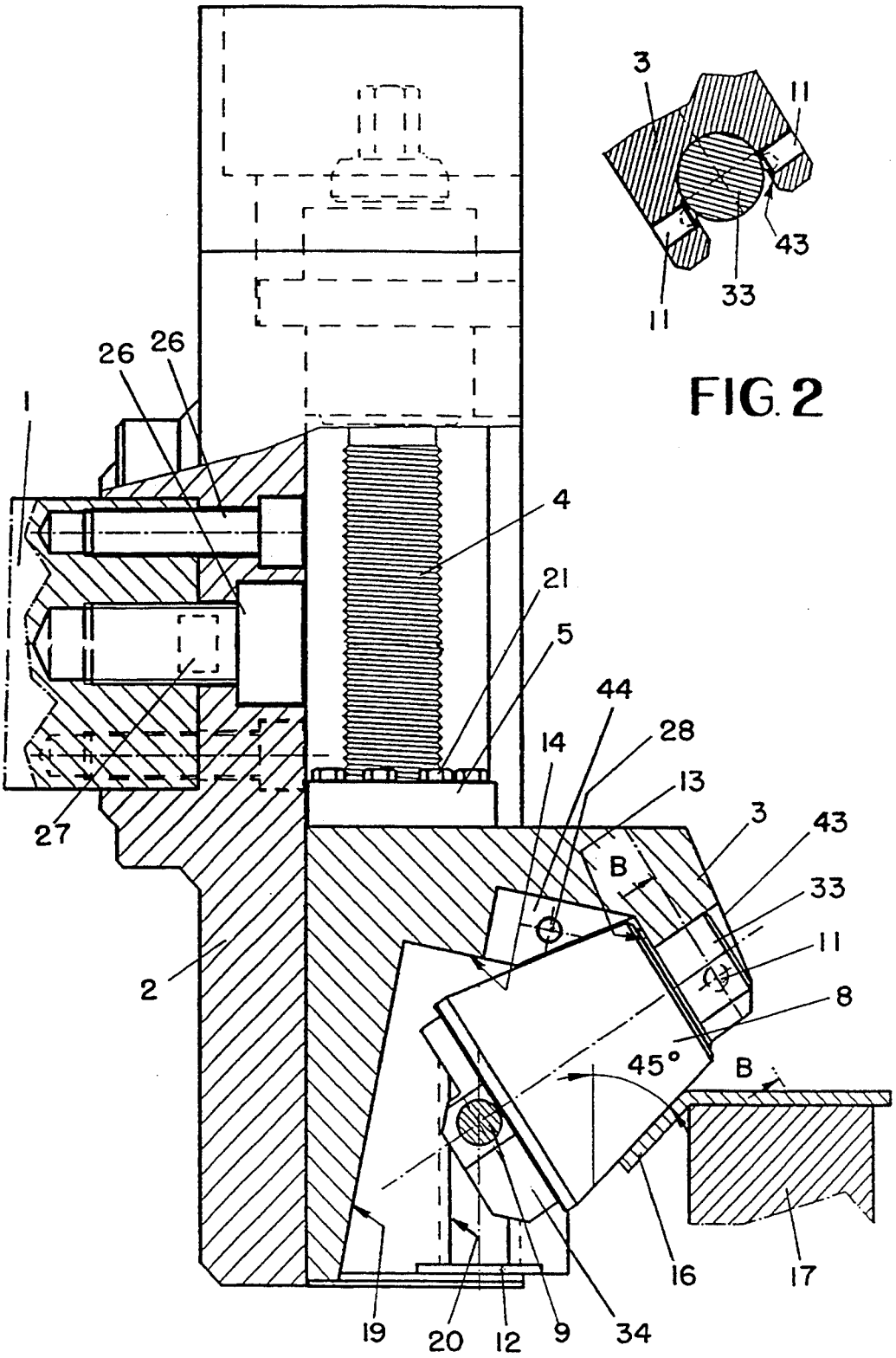
FIG. 1 presents a lateral view of the apparatus of the invention in its first position.
FIG. 2 presents a detail of FIG. 1 taken along section B—B.

FIG. 1 shows a sectioned lateral view of the apparatus of the invention. The apparatus is coupled by means of a shaft 1 to a driving gear (not shown) which supports it and rotates the shaft about its central axis, depicted with a broken line and lying parallel to the longitudinal axis of the pipe 16. During the shaping operation, the pipe 16 is held in place by clamping jaws 17. The driving gear also moves the shaft 1 in the direction of the central axis. Attached with bolts 26 to the end of the shaft 1 pointing away from the driving gear is a tool body 2. A wedge 27 is fitted at the junction between the shaft 1 and the tool body 2 to receive the torque. Mounted in the tool body 2 is a sliding carriage 3 which is movable in a direction perpendicular to the longitudinal axis of the pipe 16 and therefore to the axis of rotation of the apparatus, indicated with a broken line. Fixed with screws 21 to the carriage 3 is a nut 5 for a conveyor screw 4 used to move the carriage along a guide track provided in the tool body 2. The other end of the conveyor screw is depicted with broken lines and is described in greater detail in connection with FIG. 5.

Figures 3, 4:
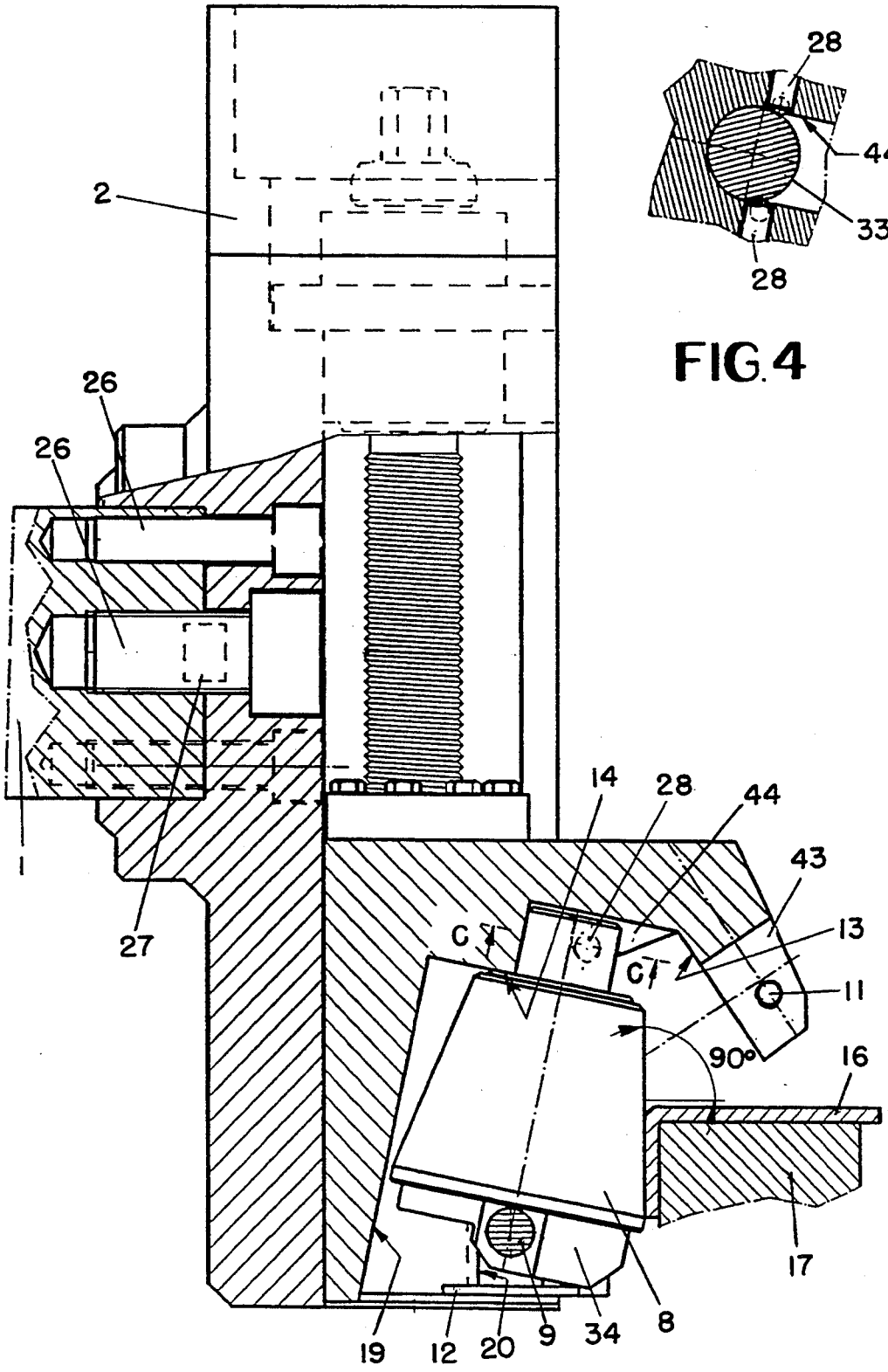
FIG. 3 presents a lateral view of the apparatus of the invention in its second position.
FIG. 4 presents a detail of FIG. 2 taken along section C—C.

On the side facing the pipe end to be shaped, the carriage has a chamber 19 for a forming cone, housing a forming cone 8 acting as a forming element. The forming cone 8 is a truncated cone whose conical surface constitutes the forming face which rolls along the pipe edge 16. The part constituting the forming face is rotatably mounted on its supporting axle on the body 34 of the forming cone, using a double-seat needle bearing construction. The body 34 of the cone is supported by a joint pin 9 at the wider end of the cone, constituting the fulcrum on which the cone turns. The joint pin 9 is fixed to a slide block 10 (FIGS. 7–8) which can move along guides 20 provided in the carriage 3. Attached to the ends of the guides 20 are stop plates 12 to prevent the slide block from coming off the guides. At the narrower end of the cone, the cone body forms a cylindrical projection 33 protruding from the cone and having a radius smaller than that of the narrower end of the cone. The carriage 3 is provided with shoulders 13 and 14 designed to receive the narrow end of the forming cone 8 in its first and second positions, respectively (FIG. 3). In FIG. 1, the forming cone 8 is in its first position, where the forming surface lies at an angle of 45° to the longitudinal axis of the pipe 16 while the cone is supported by the joint pin 9 and shoulder 13.

FIG. 2 presents a detail of FIG. 1 as sectioned along line B—B. The projection 33 of the cone rests in a slot 43 whose width corresponds to the diameter of the projection. The cone is held in place by elastic plungers 11 which are pressed against the circumference of the cylindrical projection from its outer side.

In FIG. 3, the forming cone 8 is in its second position, in which the surface being shaped is at right angles to the longitudinal axis of the pipe. In this case, the narrower end of the cone leans against shoulder 14 and the cylindrical projection is in slot 44. Correspondingly, the joint pin 9 has now moved further away from the central axis of the pipe. In other respects, FIG. 3 corresponds to FIG. 1 and the reference numbers used in the figures are the same for corresponding parts. FIG. 4 presents section C—C of FIG. 3 and shows how the projection rests in the slot 44, with elastic plungers 28 holding the cone in place in the same way as in the first position of the cone as illustrated by FIG. 2.

Figure 5:
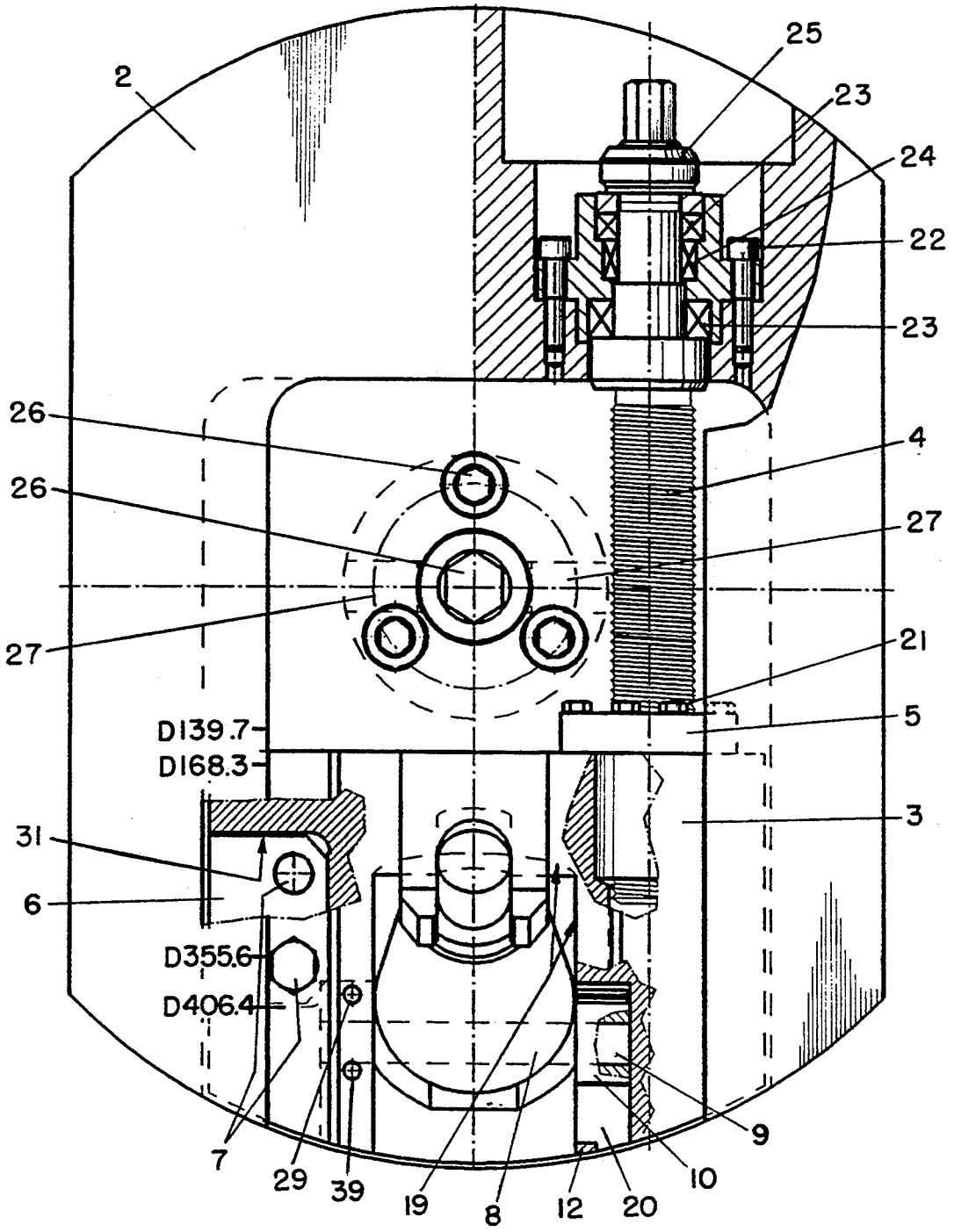
FIG. 5 presents the device of the invention as seen from the direction of the pipe.

FIG. 5 depicts the apparatus as seen from the direction of the pipe, in a partly sectioned view. The conveyor screw 4 is mounted in the tool body 2 by means of bearings placed at the side opposite to the carriage 3. The journal box of the conveyor screw is fixed with screws 22 to the tool body 2 and the conveyor screw is attached with radial 24 and axial 23 thrust bearings to the journal box. The bearing assembly is locked by a nut 25.

To fix the carriage 3 firmly to the tool body 2, the carriage is provided with a socket 31 in which a wedge-shaped locking block 6 is fitted. As illustrated more clearly by FIG. 7, the locking block is tightened against the carriage and the guide track wall in the tool body by means of a screw 7 so that the carriage is pressed tightly against the opposite wall of the guide track. These locking elements keep the carriage and the forming cone mounted on it in the appropriate position, corresponding to the diameter of the pipe. The carriage and the tool body are preferably provided with markings indicating the carriage positions corresponding to different standard pipe diameters (D139.7, D168.3, D355.6 and D406.4 in FIG. 5), thus making it easier to carry out the cone setting required for a given pipe size.

Figure 7:
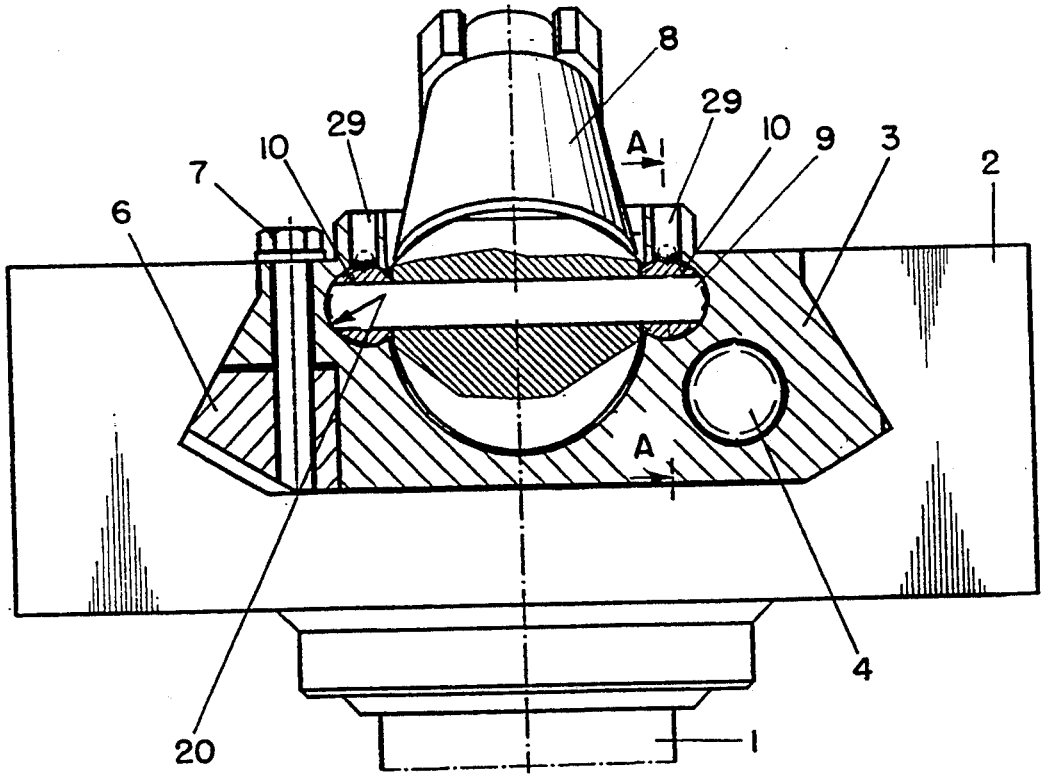
FIG. 7 presents the apparatus of the invention partly sectioned, seen from below.
Figure 8:
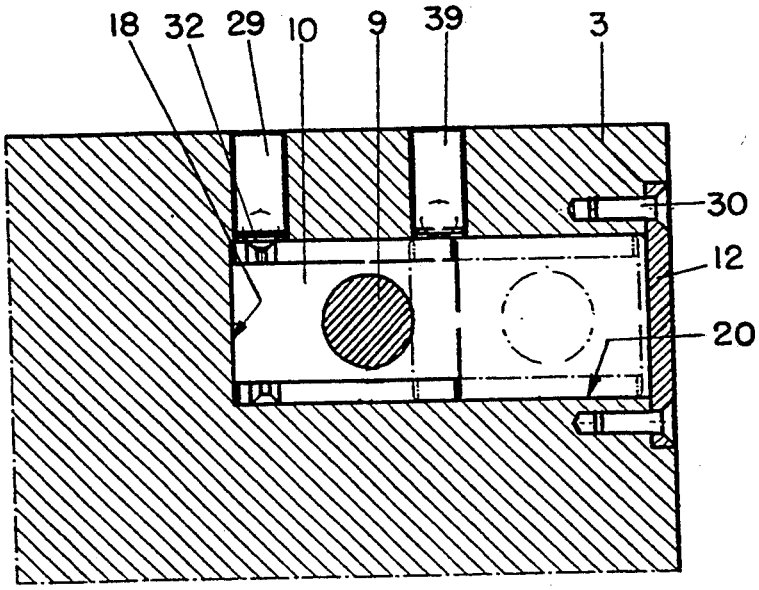
FIG. 8 presents a detail of FIG. 7 taken along section A—A.

FIG. 7 presents a partly sectioned view of the apparatus as seen from below, and FIG. 8 shows a section taken along line A—A in FIG. 7. Provided in the carriage 3 are elastic plungers 29 with a ball 32 at the end, and the slide blocks are provided with corresponding grooves designed to receive the plunger ball 32 when the slide block is in the correct position. In FIG. 8, the other position of the slide block 10 is depicted with broken lines, in which case the balls of plungers 39 are pressed into the gooves of the slide blocks. To prevent the slide blocks from coming off the guide, the travel of the slide blocks 10 is limited at one end of the guide 20 by the wall 18 and at the other end by a stop plate 12 attached to the carriage by means of fixing screws 30.

Figure 6:
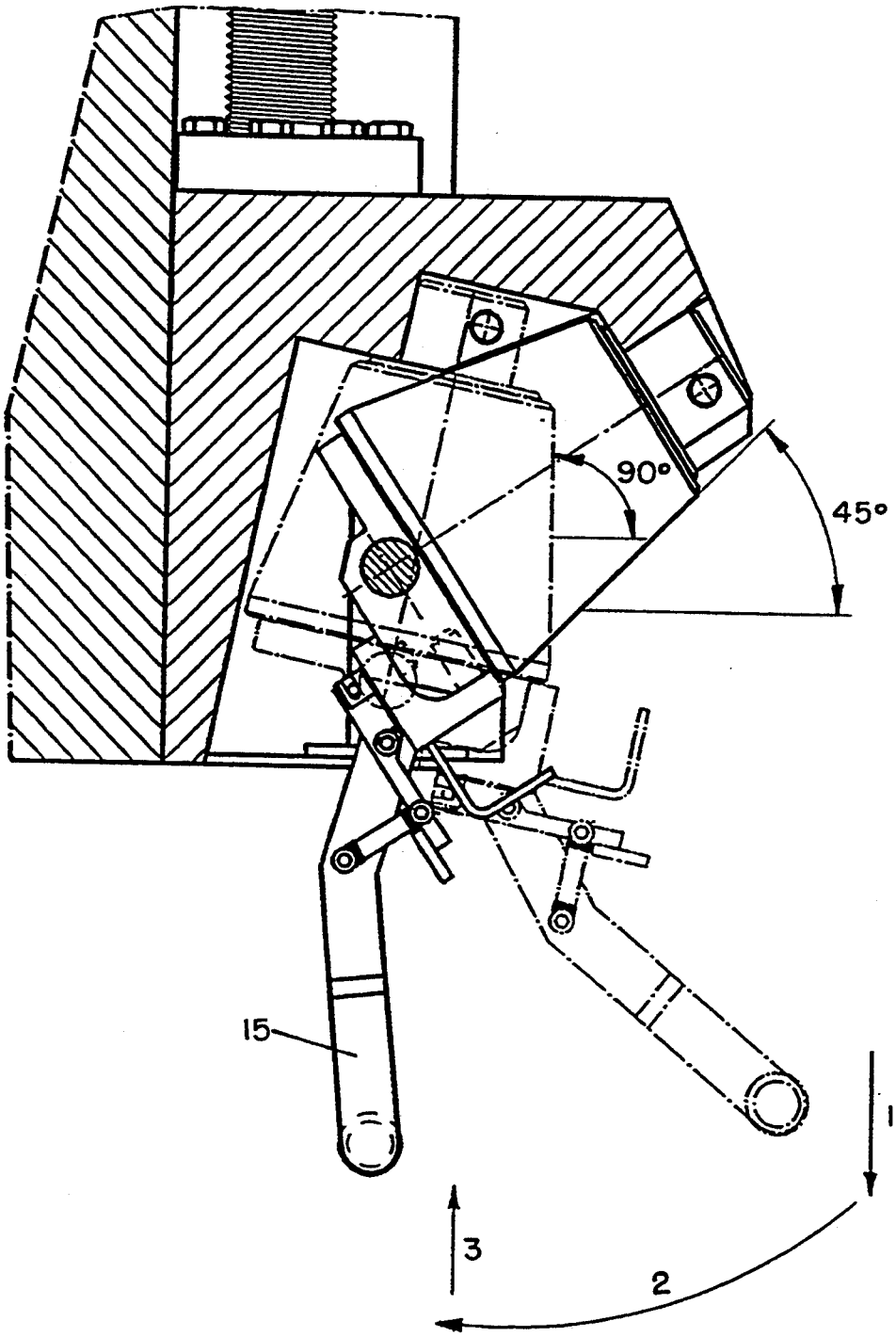
FIG. 6 presents a lateral view of the turning means of the apparatus of the invention.

FIG. 6 presents the turning lever 15 used to turn the forming cone 8, showing the lever as attached to the cone in its first position (solid lines) and in the second position (broken lines). The arrows 1, 2, 3 indicate the lever motion from the second position to the first position.

According to the invention, the shaping procedure is as follows. The pipe to be collared is fixed in position by means of clamping jaws 17. If the forming cone 8 is not in the position corresponding to the pipe diameter, the carriage 3 is moved to the required position by turning the conveyor screw 4 and secured by means of locking blocks 6. The forming cone 8 is engaged with the turning means 15 and turned into its first position, where the forming face of the cone is at an angle of about 45° to the pipe. The turning is performed by first drawing the cone outwards along the guides 20 (arrow 1, FIG. 6), then inclining the cone (arrow 2) and pushing it inwards (arrow 3). To make a conical collar at the pipe end, the shaft and the forming cone attached to it are moved towards the pipe in its axial direction by means of the driving gear. At the same time, the forming cone is rotated about the longitudinal axis of the pipe by the driving gear. When the axial motion of the forming cone is stopped by the clamping jaw 17 acting as a stopper (FIG. 1), a conical collar has been formed. The shaft is then moved back away from the pipe to allow the cone to be turned into the second position, in which the forming face is at an angle of 90° to the longitudinal axis of the pipe. The turning operation is performed in reverse order as compared to the operation described above (arrows 3, 2 and 1 in FIG. 6). The shaft is then driven again towards the pipe while rotating the cone as before until a rectangular collar has been formed.

As the fulcrum 9 of the cone on the one hand and the shoulders 13 and 14 holding the cone on the other hand are located on opposite sides of the pipe surface to be shaped, the force is effectively applied to the pipe.

In the above, the invention has been described in reference to one of its embodiments. However, the presentation is not to be regarded as constituting a restriction, but the embodiments of the invention may vary freely within the limits defined by the following claims.

I claim:

1. A method for forming a substantially rectangular collar at the end of a pipe, the pipe having a longitudinal axis and the method comprising the steps of:

providing a forming element with a forming face, the forming element being movably mounted in a carriage such that the forming element is rotatable about a central axis extending through the forming element and is movable relative to the carriage;

placing the forming element against the pipe end;

moving the forming element in an axial direction of the pipe towards the pipe;

rotating the forming element around the longitudinal axis of the pipe, the forming element being in engagement with the pipe end;

producing a conical collar at the pipe end by rotation of the forming element around the pipe end, the forming face of the forming element being at an acute angle with respect to the longitudinal axis of the pipe during production of the conical collar;

moving the forming element away from the pipe after the step of producing a conical collar;

positioning the forming element such that the forming face is substantially perpendicular to the longitudinal axis of the pipe after the step of moving the forming element away from the pipe, the step of positioning comprising, disengaging an upper end of the forming element from a first slot in the carriage by sliding the forming element relative to the carriage, pivoting the forming element about a lower end thereof to thereby move the upper end of the forming element from next to the first slot to a position next to a second slot in the carriage, engaging the upper end of the forming element into the second slot by sliding the forming element relative to the carriage;

moving the forming element back into engagement with the pipe end; and rotating the forming element around the longitudinal axis of the pipe to form a rectangular collar at the pipe end while the forming face is substantially perpendicular to the longitudinal axis of the pipe.

2. The method according to claim 1, further comprising the step of adjusting distance of the forming element relative to the longitudinal axis of the pipe at least prior to the step of producing a conical collar at the pipe end such that the forming element is adjusted to a diameter of the pipe.

3. The method according to claim 2, wherein the step of adjusting comprises moving the carriage relative to the longitudinal axis of the pipe to thereby move the forming element, the carriage being moved generally perpendicularly relative to the longitudinal axis of the pipe.

4. The method according to claim 2, further comprising the step of locking the forming element at a set distance from the longitudinal axis of the pipe after the step of adjusting.

5. The method according to claim 1, further comprising providing fulcrum points at both ends of the forming element during the steps of producing the conical collar and rotating the forming element to form a rectangular collar, the fulcrum points being located on different sides of an cylindrical outside surface of the pipe and being at a substantially equal distance from an edge of the pipe.

6. The method according to claim 5, further comprising the step of turning the forming element about the fulcrum point at the lower end thereof during the step of pivoting the forming element, the fulcrum point at the lower end of the forming element being located outside of the pipe.

7. The method according to claim 1, wherein the forming element has a joint pin at the lower end thereof and wherein the steps of disengaging and engaging the forming element comprise sliding the forming element along a generally linear path by moving the joint pin along guides provided in the carriage, the central axis of the forming element being nonparallel and nonperpendicular to the longitudinal axis of the pipe during sliding of the forming element and the forming element moving toward and away from the longitudinal axis of the pipe during sliding of the forming element.

8. The method according to claim 7, wherein the forming element is pivoted about the joint pin during the step of pivoting.

9. Apparatus for forming a substantially rectangular collar at an end of a pipe, the pipe having a longitudinal axis and the apparatus comprising:

a carriage mounted on a tool body, the carriage being movable toward and away from the pipe and being rotatable around the longitudinal axis of the pipe;

a forming element rotatably mounted on the carriage, the forming element having a forming face, the forming element also being slidably movable relative to the carriage, the forming face of the forming element being engagable with and disengagable from the pipe when the carriage moves toward and away from the pipe;

a first and second slot provided in the carriage, an upper end of the forming element being engagable and disengagable from either one of the first and second slots;

turning means for moving the upper end of the forming element between the first slot and the second slot and for pivoting the forming element about a fulcrum at a lower end thereof during movement of the forming element between the slots, the forming face of the forming element being at an acute angle with respect to the longitudinal axis of the pipe when the upper end of the forming element is in the first slot and the forming face being substantially perpendicular to the longitudinal axis of the pipe when the upper end of the forming element is in the second slot;

guides provided in the carriage, the fulcrum at the lower end of the forming element being slidable in the guides such that the lower end of the forming element is movable toward and away from the longitudinal axis of the pipe before and after pivoting of the forming element by the turning means, the turning means sliding the forming element in the guides thereby engages and disengages the upper end of the forming element from the slots.

10. The apparatus according to claim 9, wherein the first and second slots are bearing surfaces for the upper end of the forming element when the upper end of the forming element is engaged in the slots to thereby support the forming element.

11. The apparatus according to claim 9, wherein the guides are generally perpendicular to the longitudinal axis of the pipe.

12. The apparatus according to claim 9, wherein the guides are generally linear such that the forming element slides along a generally linear path toward and away from the longitudinal axis of the pipe.

13. The apparatus according to claim 9, wherein the forming element is rotatable about a central axis and wherein the central axis is nonparallel and nonperpendicular to the longitudinal axis of the pipe during the sliding of the forming element.

14. The apparatus according to claim 9, further comprising retaining elements provided at the first and second slots for holding the upper end of the forming element in the slot.

15. The apparatus according to claim 14, further comprising retaining elements for holding the lower end of the forming element in place when the upper end of the forming element is in one of the first and second slots.

16. The apparatus according to claim 9, wherein the carriage is movable relative to the tool body to move toward and away from the longitudinal axis of the pipe such that the forming element is adjustable to a diameter of the pipe.

17. The apparatus according to claim 16, further comprising locking elements fitted between the carriage and the tool body for securing the carriage in position.

18. The apparatus according to claim 9, further comprising a fulcrum point at the upper end of the forming element and wherein the fulcrum points at both ends of the forming element are located on different sides of an cylindrical outside surface of and edge of the pipe.

19. The apparatus according to claim 18, wherein both fulcrum points are located at substantially equal distances from the edge of the pipe.

20. The apparatus according to claim 9, wherein the fulcrum at the lower end of the forming element is at a joint pin extending through the lower end of the forming element.

* * * * *